United States Patent [19]

Lampton

[11] 4,274,333

[45] Jun. 23, 1981

[54] DEEPWATER TARGET-SEEKING MINES

[75] Inventor: Glen T. Lampton, Santa Monica, Calif.

[73] Assignee: The United States of America as represented by the Secretary of the Navy, Washington, D.C.

[21] Appl. No.: 862,432

[22] Filed: Dec. 28, 1959

[51] Int. Cl.[3] ..... F42B 22/04; F42B 19/00

[52] U.S. Cl. ..... 102/418; 102/411

[58] Field of Search ..... 102/14, 18, 10, 13, 102/2, 3; 114/21.1; 244/14

[56] References Cited

U.S. PATENT DOCUMENTS

| | | | |
|---|---|---|---|
| 1,440,596 | 1/1923 | Hammond | 102/14 |
| 1,588,932 | 6/1926 | Blair | 114/21 A |

OTHER PUBLICATIONS

Fish, J. R., "The Diatonic Torpedo;" Apr. 5, 1940.

*Primary Examiner*—Charles T. Jordan

*Attorney, Agent, or Firm*—R. S. Sciascia; A. L. Branning

EXEMPLARY CLAIM

1. A buoyant target-seeking mine comprising, a hollow casing having nose, body, and tail sections, a hydrophone assembly mounted in said nose section, steering elements mounted on said tail section, amplifying circuit means connected to said hydrophone assembly, means influenced by said circuit means to move said steering elements in a direction to steer said mine toward a target producing sound above a predetermined amplitude, an orifice in said tail section for the passage of water ballast into and out of said casing, a first independent buoyancy control means for maintaining a predetermined amount of said ballast water in said casing during descent of said mine to anchorage, said ballast water being retained in said casing during said anchorage, a second buoyancy control means under the control of said circuit means for exhausting said ballast water, means for releasing the mine from said anchorage when said sound producing target influences said circuit means whereby said mine is free to rise rapidly to the surface of the water by reason of the increased buoyancy of said casing, and means under the control of said circuit for steering said mine toward said noise-producing target during its rise to the surface.

5 Claims, 15 Drawing Figures

DEEPWATER TARGET-SEEKING MINES

The present invention relates to target-seeking mines which are anchored in deep water and wherein the mine is made highly buoyant during its travel from anchorage to a target, such buoyancy being employed as the propelling force.

Prior art mines have been developed wherein a mine is released from anchorage to rise vertically to intercept a moving target, but such mines are characterized by a high percentage of misses. It is obvious that unless the target passes directly over the point of release of the mine, a miss is almost inevitable. In the event that the target passes directly over the anchorage point, tidal and other currents, as well as the speed of the target with respect to speed of the mine and depth of release present further probable causes of missing the target. An example of the unguided form of buoyant mine is that of the Schwab U.S. Pat. No. 2,349,009 wherein after having been released beneath a target, the device is without further guidance. It is also well-known in the prior art to steer mechanically propelled torpedoes toward a target by acoustic means, such, for example, as shown in U.S. Pat. No. 1,121,563 to Leon. However, torpedoes of the mechanically propelled type are complicated, costly and are not suitable for anchoring underwater for long periods of time.

The present invention combines the simplicity and economy of a buoyancy propelled mine with the additional advantage of guidance during its travel toward a target.

The mine of the present invention is of such dimensions that it may be mounted in the bomb-bay of an aircraft for laying from the aircraft in flight. The mine may also be inserted in a torpedo tube of a submarine for laying therefrom while the submarine is submerged. The mine may also be laid from surface vessels in any manner desired such, for example, as dropping over the side of a ship. It is likewise possible to mount the mine on the exterior of an aircraft, for example, by brackets on the underside of the wings.

When laid from an aircraft in flight, a parachute contained in the casing of the mine is released in a conventional manner to retard the descent of the mine through the air. On striking the water, the parachute may be released. As the mine sinks in the water, a predetermined slightly negative buoyancy is provided to retard the descent of the mine, thus to prevent damage to the casing or mechanism contained therein when the mine reaches the bottom, the maximum desirable depth of submersion being in the order of 500 fathoms. The mine releases an anchor and sufficient cable is payed out to maintain the mine in a vertical position a predetermined distance from the bottom.

A hydrophone assembly tiltably mounted in the nose of the mine is used in conjunction with a listening circuit to detect the presence of a moving ship or submarine in a predetermined cone of influence above the mine. When a signal such as that caused by the propellers of a ship is received, another circuit is closed which releases the anchor and cable, blows out ballast to provide high buoyancy, and energizes the tracking circuit and associated mechanism, including fin actuators, for directing the mine toward the target ship.

It is to be noted that during the period of anchorage the mine is fastened to the anchor cable in such a manner that tilting motion of the mine caused by tides and currents is reduced to a minimum, thus the cone of influence above the mine remains substantially fixed.

The casing of the mine is formed of light-weight material such, for example, as aluminum, or the casing or portions thereof may be made of a plastic reinforced with fiberglass. The casing has a hydrodynamic shape which provides, in cooperation with the fins, stability of travel through the water on its course toward a target. Pressure within the casing is maintained equal to the ambient pressure exterior of the mine, thus relieving the casing of stresses due to high exterior pressures developed as a function of depth.

The rear or bottom of the mine is provided with an opening in communication with the surrounding water to provide for the aforesaid equalization of pressures and to admit or expel water to maintain a predetermined quantity of water ballast in the mine casing thus to provide a limited buoyancy at any depth of submergence. Means is provided for exhausting the water ballast when the detecting circuit is influenced by an acceptable signal, thus to facilitate rapid travel of the mine toward the target, propelled by its buoyancy and steered by the fins thereof.

An object of the present invention is to provide a steerable target-seeking mine wherein the propulsive force is derived from the buoyancy of the mine.

Another object is to provide a target-seeking mine capable of being laid from an aircraft, a torpedo tube or any suitable laying means.

Still another object is to provide a target-seeking mine which upon entering the water will sink and be anchored a predetermined distance above the bed of the water.

A further object is to provide a target-seeking mine which is statically and dynamically stable and which, at the same time, readily answers to the control of the guidance system.

A still further object is to provide a target-seeking mine wherein the water ballast which enters the casing during the descent of the mine is maintained at a substantially constant value, thereby to maintain a predetermined buoyancy to control the rate of descent of the mine to its anchored position.

Another object is to provide a target-seeking mine wherein a predetermined cone of influence is maintained above the mine.

Still another object is to provide a target-seeking mine wherein the mine is directed toward a target by acoustic signals received by a hydrophone assembly automatically tiltable toward the source of such signals.

Other objects and many of the attendant advantages of this invention will be readily appreciated as the same becomes better understood by reference to the following detailed description when considered in connection with the accompanying drawings wherein.

Figure 1:
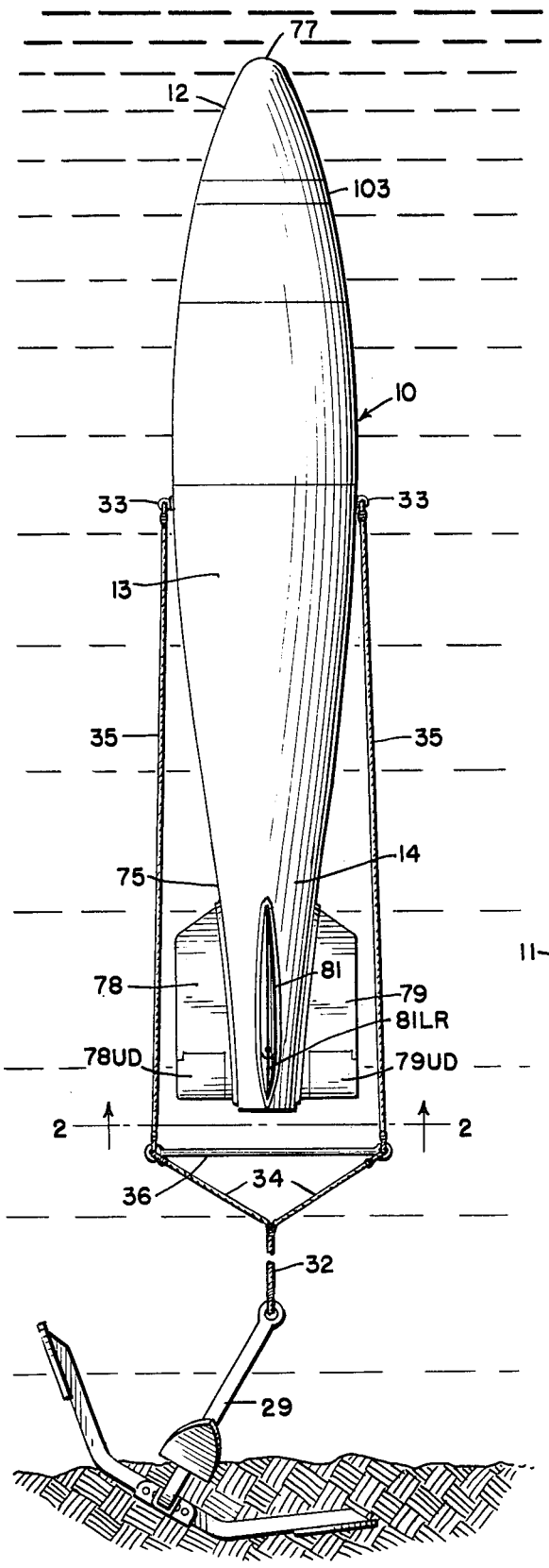
FIG. 1 is a side elevation of the mine of the present invention shown anchored in a body of water and in a vertical position.
Figure 2:
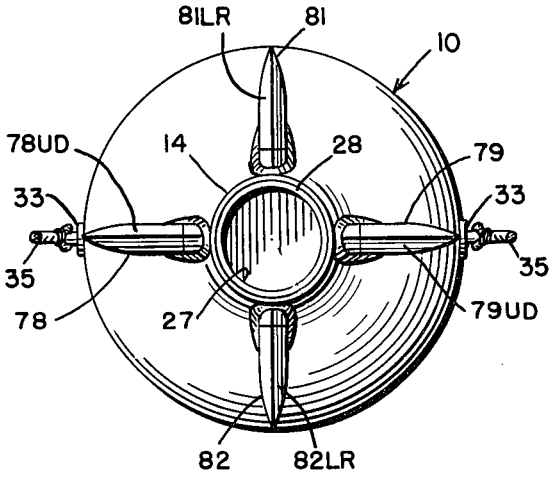
FIG. 2 is a sectional view taken along line 2—2 of FIG. 1.
Figure 7:
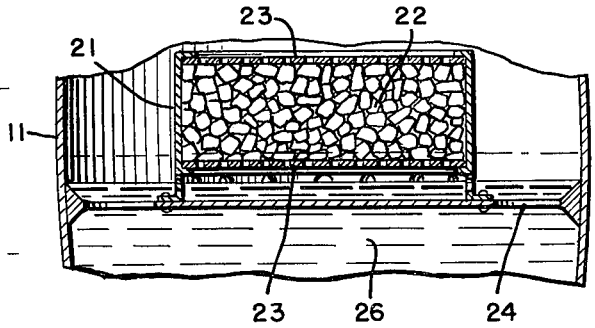
FIG. 7 is a sectional view showing the calcium hydride gas generator.
Figure 3:
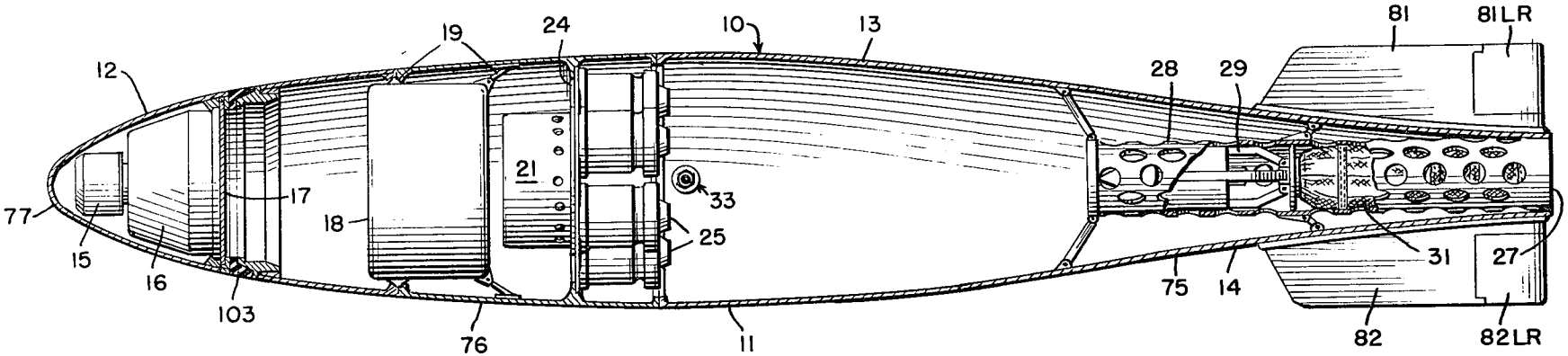
FIG. 3 is a longitudinal sectional view through the mine case showing certain elements in elevation, the mine being in a horizontal or prior-to-laying position.

Referring more particularly to the drawings wherein like numerals indicate like parts throughout the several views, 10 indicates generally the mine of the present invention. Mine 10 is provided with a hydrodynamically shaped casing 11 of thin light-weight material such as, for example, aluminum, fiberglass reinforced plastic or other suitable material. The casing 11 comprises a blunt pointed nose section 12, a main body section 13, and a tail section 14. The shape is such that a high maximum speed is attained without excessive turbulence or cavitation. As shown in FIG. 3, the tail section 14 is provided with a slight inverse curve 75, the body section being outwardly curved as at 76 from the nose which is rounded as at 77.

The nose section 12 encloses a hydrophone assembly 15 and a housing 16 containing electronic control equipment to be hereinafter more fully described. A bulkhead 17 separates the nose section 12 from the body section 13. The nose section filled with a suitable fluid surrounds the hydrophone assembly casing and housing 16. The fluid is maintained at ambient pressure by a bellows device (not shown) in bulkhead 17.

A warhead 18 is spaced from bulkhead 17 and is mounted in body section 13 by brackets or the like 19. While it is not shown, the warhead may contain a conventional main explosive charge, booster charge and an electric squib or detonator which is fired by impact with the target. A suitable impact operated switch is employed to energize an electrical circuit in a conventional manner. A parallel firing circuit controlled by a pressure switch is also employed whereby the main charge is fired as the mine rises out of the water, in case of a near miss.

Mounted in the body 13 is a ballast level maintaining device which may be in the form of a hydrogen gas generator 21 located at the desired level of water ballast within the casing 11, the water ballast being maintained at the desired level by the generation of gas caused by the water contacting a quantity of an alkaline metal hydride such as calcium hydride or other suitable gas producing chemical solid 22 due to the level of the water rising as pressure increases within the casing during the descent of the mine to anchorage depth. The chemical solid is retained in generator 21 by a pair of screens or grids 23. Bracket 24 supports the gas generator 21 in casing 11.

Bracket 24 also supports a plurality of ballast-blowing gas generators 25 which are employed to expel the entire water ballast 26 when mine 10 is released from its anchorage as will be hereinafter fully described.

An opening 27 is provided at the end of mine casing 11 in tail section 14. A perforated sleeve 28 extends axially within the casing and communicates with opening 27. Prior to launching of mine 10, the sleeve 28 contains anchor 29 and, if the mine is to be launched from an aircraft, a parachute 31. Well-known means are provided for releasing the parachute 31 and the anchor 29 at the proper times.

The operation of the mine of the present invention will now be described. The mine is launched, for example, from an aircraft in flight, either from the bomb bay or from brackets on the exterior of the aircraft. As the mine falls away from the aircraft, the parachute 31 is pulled from sleeve 28 through opening 27 of casing 11 by a static line (not shown). The parachute opens, retarding the descent of the mine through the air. On striking the water, the parachute is automatically detached from the mine. While the foregoing is applicable when the mine is dropped from an aircraft, it is also contemplated that the mine may be laid from the deck of a ship or from a submarine. In that case, the parachute may be omitted.

The anchor 29 offsets the positive buoyancy of the mine and, as the mine descends through the water, the interior of the casing 11 is partially filled with water due to the increase of pressure with depth, compressing the air trapped within the mine. The water enters opening 27 and passes through the perforations of sleeve 28 into the casing. As water pressure increases as a function of depth, the water level reaches the lower screen 23 of gas generator 21 which wets the calcium hydride 22 contained therein. The mixture of calcium hydride and water causes a well-known chemical reaction wherein hydrogen gas is generated, which raises the pressure in the casing and forces a quantity of water to be exhausted from the mine through opening 27. When the level of the water has reached a level below the lower screen 23, the generation of gas ceases until a greater depth is reached, raising the level of the water and causing a repetition of the gas generating cycle. The purpose of this is to generate sufficient gas within the body of the mine to maintain a condition of constant slight negative buoyancy for the mine to limit the rate of descent and prevent the mine from being damaged by too violent contact with the bottom.

Figure 8:
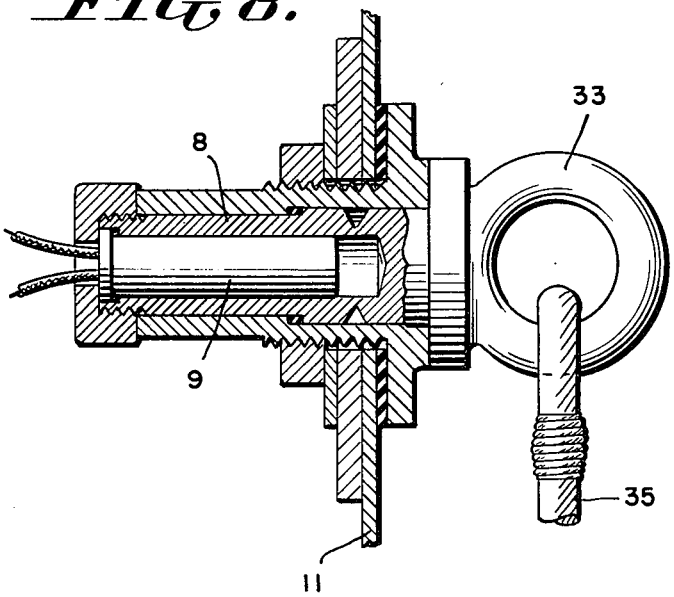
FIG. 8 is a sectional view showing one of the explosive pins for releasing the anchor cable.

When mine 10 reaches the bottom of the body of water, the anchor 29 is released from sleeve 28 by a release mechanism not shown. Mine 10 being of slightly positive buoyancy rises as anchor cable or chain 32 is payed out of sleeve 28 until it reaches a predetermined distance above the bottom of the body of water, such distance being governed by the length of cable 32. The anchor cable 32 is bifurcated as at 34 to provide a pair of vertical spaced portions 35. A yoke or spreader 36 between the portions 35 below the tail of the mine maintains the spacing therebetween. The upper ends of portions 35 are secured to a pair of eye pins 33 as shown in FIG. 8, the pins being of a type which is readily detachable from the casing 11, such as, for example, hollow pins 8 containing an explosive charge in the form of an electric detonator 9, to cause the eyes of the pins to break away from the casing, thus freeing the mine from the anchor and cable assembly and permitting the mine to rise to the surface.

The eye pins 33 are mounted on casing 11 below the center of buoyancy and at diametrically opposed points at the center of pressure of the lateral hydrodynamic forces resulting from tidal or other cross currents, thus the mine is maintained in a substantially vertical position during anchorage in waters where such cross currents are prevalent.

The hydrophone assembly 15 is initially trained along the longitudinal axis of the mine so that its cone of sensitivity will encompass a circular area of the water surface immediately above the mine. By maintaining the mine in a vertical position under all conditions while at anchor, the surface area covered will not vary.

It is to be noted that the anchor cable 32 may be made of nylon or other material having a specific gravity of approximately 1.0 in order that the weight of the cable will be negligible during anchorage and will not disturb the slight buoyancy of the mine regardless of the length of the cable.

During the period of anchorage a listening circuit which is energized by battery 30 is connected to the hydrophone assembly 15. By referring to FIG. 15 it will be seen that this circuit includes four single hydrophones or groups of series-connected hydrophones arranged in quadrants of a circular area as at 37, 38, 39 and 40. The outputs of each of these groups pass through a relay-operated gang switch 41 which comprises circuit selectors 42, 43, 44 and 45, and relay 46. In the initial position the circuit selectors connect in parallel all hydrophones to listening amplifier 47 which may be any suitable electronic amplifier capable of amplifying the output of the groups of hydrophones 37, 38, 39 and 40 to a usable level, preferably a transistor amplifier having low current drain.

The output of listening amplifier 47 is fed into a sequence control 48. When the signal from the hydrophones reaches a predetermined level such as that provided by the noise of the propellers or hull vibrations of a ship or submarine within the cone of sensitivity of the hydrophones, a sensitive relay of the sequence control 48 energizes relay 46 which shifts the circuit selectors 42, 43, 44 and 45 to a second position where each quarter or quadrant of hydrophones of the hydrophone assembly 15 is separately fed into an electronic switch 53.

Upon being released, the mine will ordinarily be guided in one direction or another and will depart from its vertical position, the terms "left", "right", "up" and "down" being used hereinafter in connection with the direction of guidance. Since all control actions are symmetrical about the axis and the actual position of the mine will determine the specific control mechanism operated for guidance in a given direction, the particular nomenclature used is merely exemplary and not necessarily indicative of the actual direction of control.

The switch 53 alternately connects the "right" pair of hydrophones 37, 38 and the "left" pair of hydrophones 39, 40; and the "up" pair of hydrophones 37, 40 and the "down" pair of hydrophones 38, 39. Respective pairs of hydrophones are connected to corresponding tracking amplifiers 49 and 50, amplifier 49 being alternately connected to "left" and "up" pairs, while amplifier 50 is simultaneously alternately connected to "right" and "down" pairs. Coincident with the operation of switch 53 connecting the sections of the hydrophone into left-right and up-down arrangements, switches 54 and 55 alternately connect the outputs of tracking amplifiers 49 and 50, respectively, to phase detectors 56 and 57.

It will thus be seen that during one period of each cycle "left" and "right" signals are fed through phase detector 56 into training amplifier 63, while during the alternate period of each cycle "up" and "down" signals are fed through phase detector 57 into training amplifier 64. These cycles of operation are repeated at a rate that is fast relative to the time required to actuate the controls, thus creating no time delay in the actual guidance control. This arrangement has the advantage of obtaining greater output signals for a given hydrophone size and requires only two tracking amplifiers instead of four that would be required if each of the four sections of the hydrophone were provided with individual amplifying and actuating circuits. The outputs from training amplifiers 63 and 64 cause the operation of training actuators 65 and 66 respectively, which tilt the hydrophone assembly 15.

Figure 5:
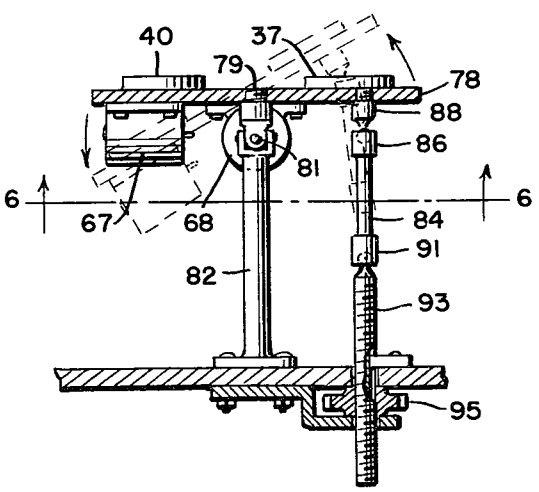
FIG. 5 is a vertical sectional view through the hydrophone assembly.
Figure 4:
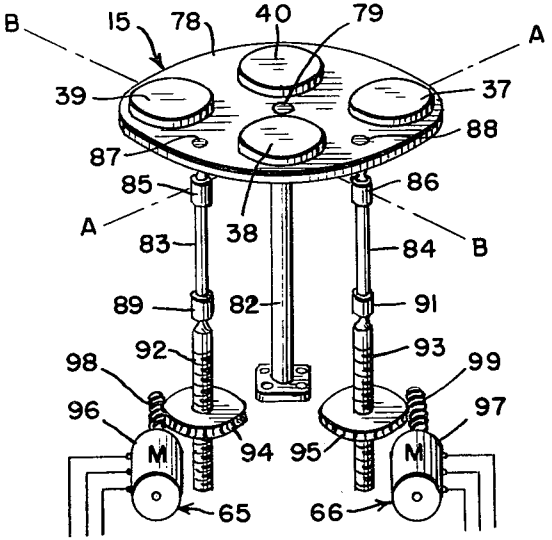
FIG. 4 is a perspective view of the hydrophone assembly.
Figure 6:
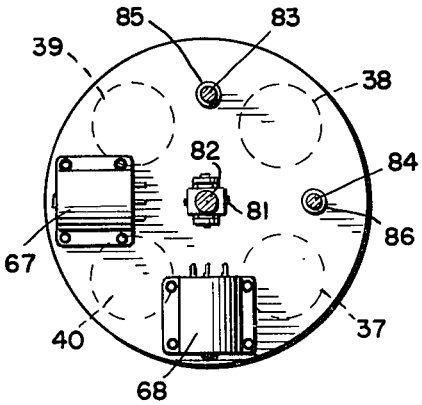
FIG. 6 is a sectional view taken along the line 6—6 of FIG. 5.

The hydrophone assembly 15, which is shown schematically in FIGS. 4–6 comprises the group of hydrophones 37, 38, 39 and 40 which are mounted on a generally circular plate 78. Plate 78 is affixed at its center to a short shaft 79 which has a universal joint 81 at the lower end thereof. A second shaft 82 is connectd by universal joint 81 to shaft 79, the shaft 82 being fixedly secured to the housing 16 or other firm support in casing 11 and aligned along the longitudinal axis thereof.

As shown in FIG. 5, plate 78 on which the hydrophones are mounted is tiltable on axes A—A and B—B which intersect at the center of universal joint 81 and the longitudinal axis of the mine casing 11. Axis A—A is positioned 90° with respect to axis B—B. A pair of tilting rods 83, 84 are joined to plate 78 by means of ball joints 85, 86, respectively, and short connectors 87, 88. The centers of ball joints 85, 86 are respectively aligned with axes A—A and B—B. Second ball joints 89, 91 connect rods 83, 84 to screw shafts 92, 93. Shafts 92, 93 are free to move vertically and are fixed against rotation as by keys and keyways. Worm wheels 94, 95 are threaded on shafts 92, 93 and are driven by training actuators 65 and 66 in the form of reversible servomotors 96, 97 through worms 98, 99 mounted on the motor shafts. It is clear from the foregoing that when servo-motor 96 is rotated, worm 98 rotates worm wheel 94 which, in turn, moves shaft 92 either up or down in accordance with the direction of rotation of motor 96. This vertical motion causes plate 78 to pivot on axis B—B, thus to tilt the hydrophones in a direction toward an acceptable target signal. Servo-motor 97, of course, through its drive connections with plate 78 causes the plate to tilt on axis A—A.

Dependent on the magnitude and polarity of the output signals from training amplifiers 63 and 64, either of the motors 96, 97 may rotate to tilt or train the hydrophones, or both may rotate in the same or opposite directions and for a different number of revolutions to provide for tilting or training in all directions and all angles of tilt.

Figure 12:
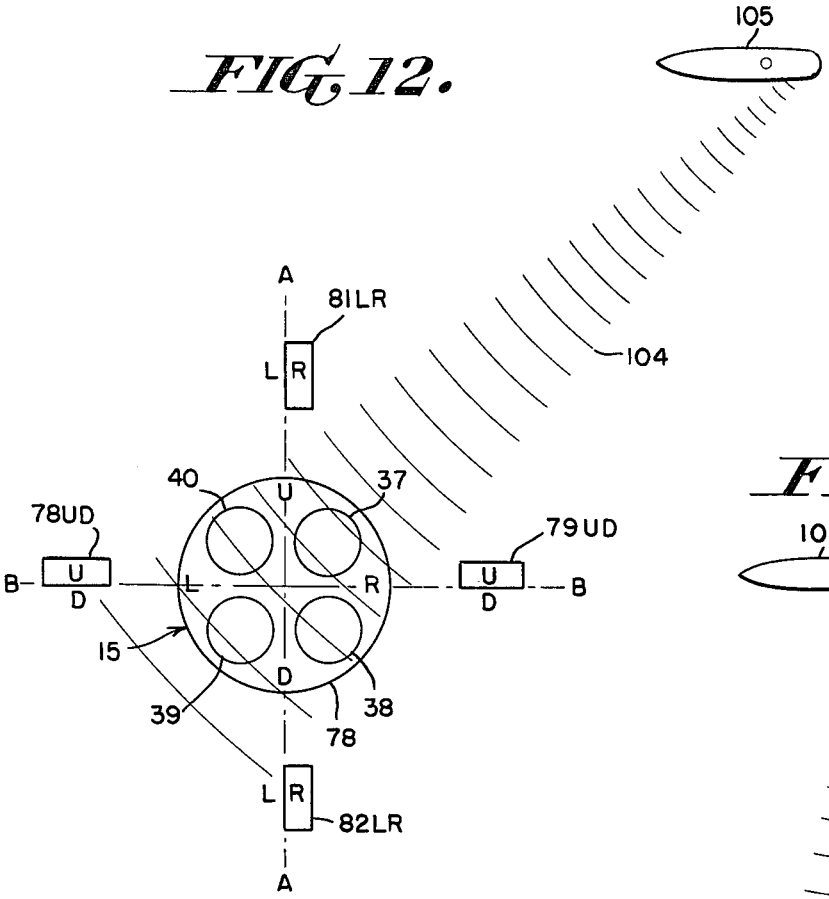
FIG. 12 is a diagrammatic plan view showing the hydrophone assembly receiving a signal at a 45° angle with respect to axis B—B.

As shown in FIG. 12, a signal 104 caused by ship 105 reaches the hydrophone assembly at an angle of 45° with respect to axis B—B. Electronic switch 53 selects pairs of hydrophones in "up", "down", "right" and "left" relation at a very rapid rate to ascertain the direction from which the signal has been received. The outputs of "right" hydrophones 37, 38 and "left" hydrophones 39, 40 are compared in phase detector 56 and found to be out of phase. As the combined output of the "right" hydrophones, leads, in phase, the output of the "left" hydrophones, the "left-right" steering fins are turned to the "right" position. Likewise, the outputs of "up" hydrophones 37, 40 and "down" hydrophones 38, 39 are compared in the phase detector 57 and found to be out of phase. As the combines output of the "up" hydrophones leads, in phase, the output of the "down" hydrophones, the "up-down" steering fins are turned to "up" position. Thus, the mine is steered in a direction toward the target ship in a manner which will hereinafter be explained.

Figure 13:
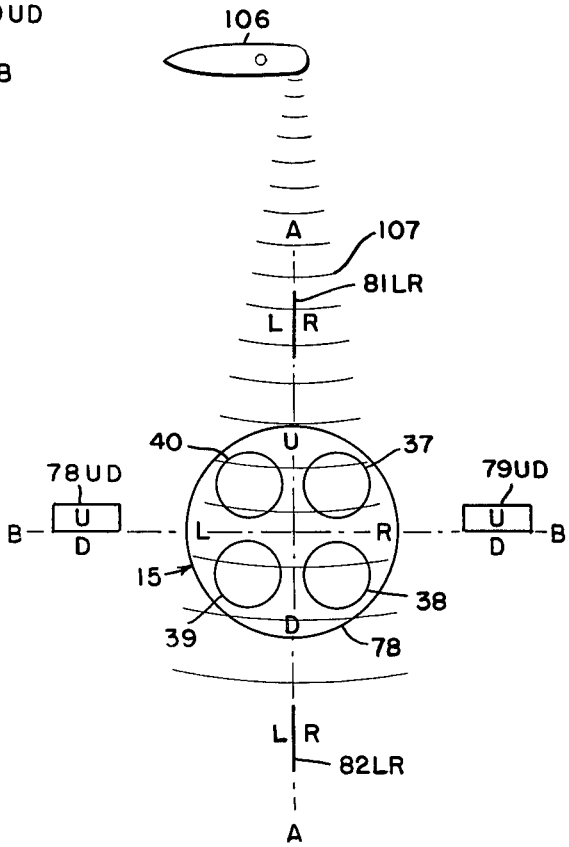
FIG. 13 is a diagrammatic plan view showing the hydrophone assembly receiving a signal along axis A—A.

FIG. 13 shows another condition wherein a signal 106 of ship 107 is received by the hydrophone assembly in a direction aligned with axis A—A. The outputs of "up" hydrophones 37, 40 are compared in phase detector 57 with "down" hydrophones 38, 39 and are found to be out of phase, while the outputs of "right" and "left" hydrophones in phase detector 56 are found to be in phase. Thus, as the combined output of the "up" hydrophones leads in phase the output of the "down" hydrophones, the "up-down" steering fins are turned to the "up" position and the training mechanism tilts the hydrophone disc in that direction. The "right" and "left" hydrophones being in phase produce no effect on the "right-left" steering fins or the training mechanism.

It is clear from the foregoing that each hydrophone serves a dual purpose, for example, hydrophone 37 serves as an "up" hydrophone when paired with hydrophone 40 and as a "right" hydrophone when paired with hydrophone 38.

It is understood that while a specific embodiment for tilting the hydrophone assembly has been described it is conceivable, for example, that solenoids or any desired means may replace the servo-motors as the driving means. Thus it is to be understood that the tilting mechanism may be modified within the limits of the appended claims. It is also to be understood in regard to FIG. 15 that the various elements shown diagrammatically in the form of blocks are well known in the art and form no part of the present invention. It will be seen that the motors will be actuated by current developed in the tracking circuit in accordance with signals received from the target, as has heretofore been described.

In order to prevent vibrations of the casing 11 from reaching the hydrophones during the run toward a target, the mounting therefore may be isolated from the casing by a ring of resilient material 103 which will absorb such vibrations and prevent to a great extent the reception by the hydrophones of spurious signals which are transmitted by the casing.

Training actuators 65 and 66, by tilting plate 78, also actuate rate gyros 67 and 68 which are mounted on plate 78 and which provide output signals having a polarity dependent upon the direction of movement and having a magnitude dependent upon the rate of movement of the training actuators. These signals are amplified in servo amplifiers 69 and 71 and operate fin actuators 72 and 73 to control the position of the fins. Feedback signals are provided to the servo amplifiers to inhibit any tendency of the fins to move in response to hydrodynamic forces and to improve the accuracy of control. Mounted on the casing 11 at tail section 14 are "up" and "down" fins 78, 79, and "left" and "right" fins 81, 82. Fins 78, 79 are provided with pivoted steering portions 78UD, 79UD, while fins 81, 82 are provided with pivoted steering portions 81LR, 82LR.

Figure 14:
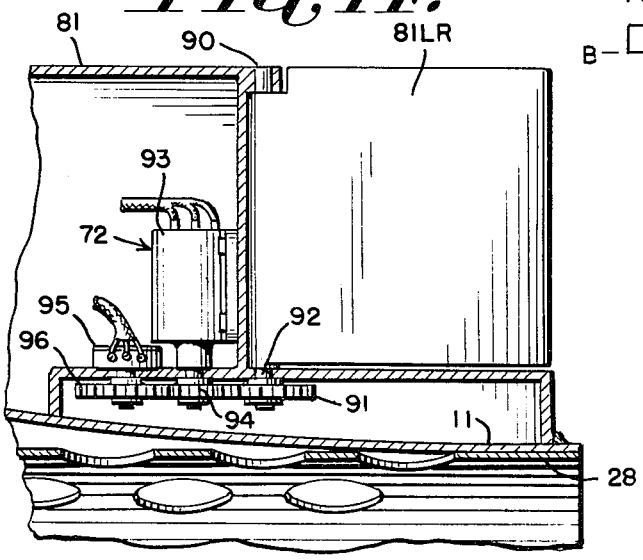
FIG. 14 is a sectional view of one of the fins showing the operating mechanism for the movable portion thereof.

Steering portions 78UD and 79UD are operatively connected to fin actuator 73, while steering portions 81LR and 82LR are operatively connected to fin actuator 72. Each actuator may take the form of a pair of servo-motors operated in unison by the respective servo-amplifier. For example, one motor operates fin portion 81LR, while another motor operates fin portion 82LR in the same direction. Both motors move in unison in response to the output of servo amplifier 69 and constitute the fin actuator 72 shown in FIG. 15. As shown in FIG. 14 fin portion 81LR is pivoted at 90 to fin 81. A gear 91 is fixed to one end of pivot shaft 92. A servo-motor 93 is provided with a gear 94 meshing with gear 91. A feed back potentiometer 95 is provided with a gear 96 also meshing with gear 91, thus potentiometer 95 is driven in accordance with the movement of fin 81LR. Thus steering portions 78UD, 79UD are controlled by fin actuator 73 to move in either "up" or "down" directions from the neutral position, while steering portions 81LR, 82LR are controlled by fin actuator 72 to move in either "left" or "right" directions from the neutral position, each in accordance with the direction from which the signal is received by the hydrophone assembly 15, as heretofore described.

Figure 15:
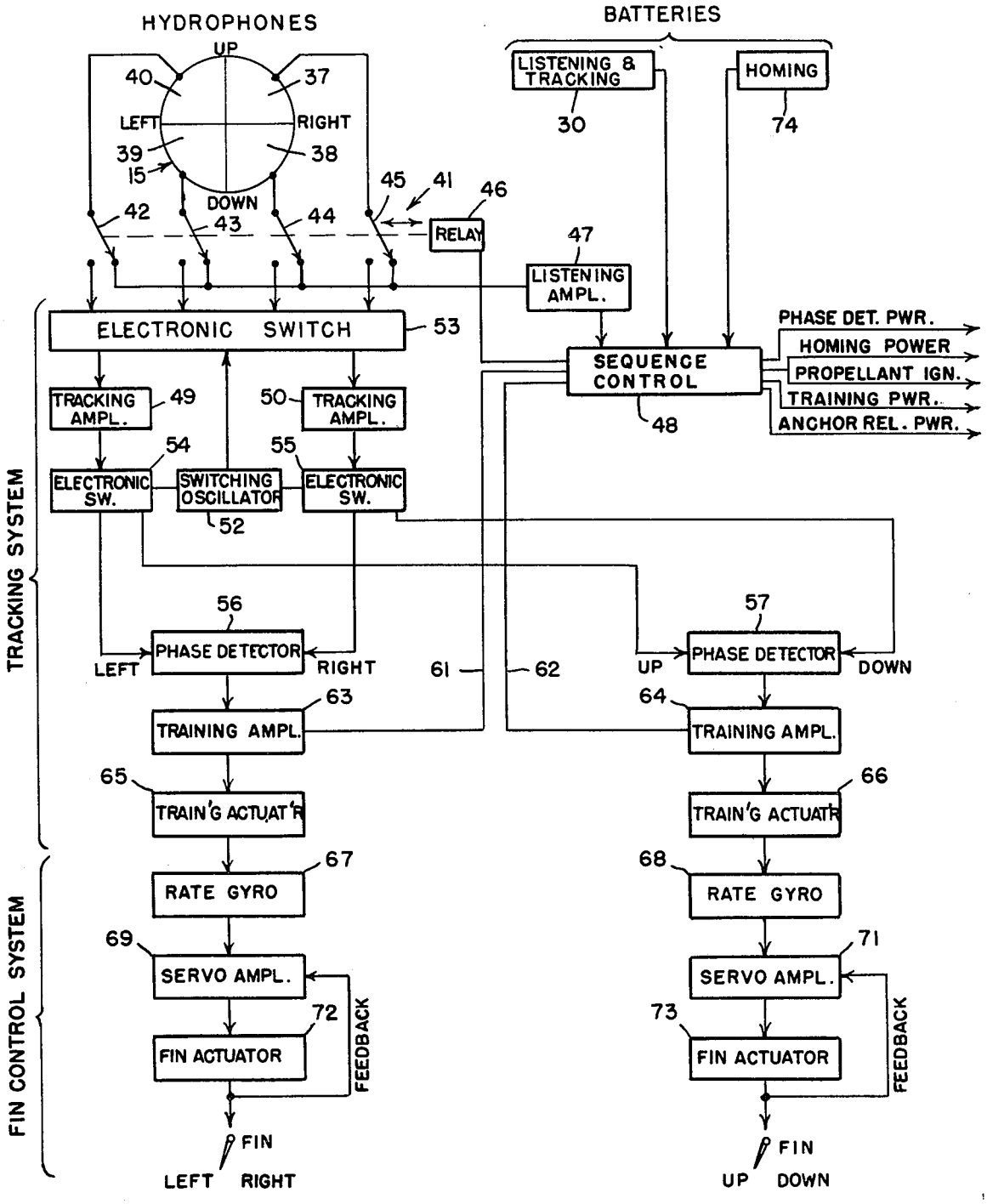
FIG. 15 is a schematic diagram of the electrical circuit of the mine.

Referring particularly to FIG. 15, the sequence of operation is as follows. When a signal is first received from a target coming into the cone of sensitivity of the hydrophone assembly, the output of listening amplifier 47 will operate the sensitive relay in sequence control 48 to energize relay 46 and to apply power to tracking amplifiers 49 and 50, switching oscillator 52, electronic switches 53, 54, and 55, phase detectors 56 and 57, training amplifiers 63 and 64 and training actuators 65 and 66. Under listening conditions, the hydrophones are pointed straight up along the longitudinal axis of the mine. The first sound from a surface vessel will originate at the periphery of the cone of sensitivity. Since this sound will reach at least one group of the hydrophones before the other groups, the signals fed to the phase detectors from the respective groups of the hydrophone assembly will be out of phase, and the phase detector outputs fed to the training actuators through the training amplifiers will cause the training actuators to tilt the training linkage in a direction to minimize the phase difference thus pointing the hydrophone assembly toward the target. When the hydrophones are pointing directly toward the target, the signals or outputs of all the hydrophones will be in phase and the output from the phase detectors will drop to zero. This signal is fed back to sequence control 48 via lines 61 and 62.

In the event that the hydrophones cannot be brought immediately to a null position with respect to the target, the sequence control 48 will hold the mine in readiness until the target does come within range. If such does not occur, the signal will eventually decrease below the predetermined level of acceptance and the sequence control will return the mine to the initial or listening condition.

In the event that the sensitive relay of the sequence control is operated by ambient noise (noise other than that caused by a ship or submarine) and neither of the phase detectors receives evidence of a target, the sequence control will return the circuit to listening condition after a predetermined period of time to prevent excessive use of phase detection power.

On the other hand, if the hydrophone assembly can be trained on the target, a null condition will be sensed in lines 61 and 62. When the null is obtained, sequence control 48 closes a homing power circuit to rate gyros 67, 68, sevo amplifiers 69, 71, fin actuators 72, 73, an ignition circuit for the ballast-blowing gas generators 25, and activates a homing circuit battery 74 by flooding the battery with an electrolyte in well-known manner, thus all of the foregoing circuits are energized when the battery 74 is activated. The sequence control 48 also closes an anchor release circuit for releasing the mine 10 from the anchor and cable as has been heretofore described.

In regard to the batteries which provide the power for the circuits of the present invention, the listening and tracking battery 30 may be of a low capacity long life type. Such long life is aided by reason of the low power requirements of the listening and tracking circuits through the use of transistors, subminiature tubes and other economies in power consumption. Preferably mercury cells will be used to provide this power, such cells having a life expectancy of at least six months.

The homing battery 74, on the other hand, provides high power for approximately three minutes, and is of the type which may be stored for a long period of time without deterioration and is maintained hermetically sealed until the instant of receiving an acceptable target signal by the listening circuit at which time the cells are flooded with an electrolyte, thus activating the battery.

The hydrodynamic properties of the mine are so designed as to cause it to continue in a straight course as long as no control actions are impressed on the fins. In the homing condition with the ballast blown the center of buoyancy is made to be coincident with the center of lateral forces so that no turning moment will be exerted tending to deflect the mine from its course. On the other hand, the inverse curve 75 in the hull shape is designed to reduce the stability of the hull sufficiently to make the control action easier, thus requiring a minimum amount of control power to change course, and no control power as long as the course need not be changed.

When the mine 10 is released, the hull 11 is pointing straight up while the hydrophone assembly 15 within the nose has been trained to point directly toward the target. The expulsion of the water ballast by the gas generators 25 will give the mine an initial upward velocity and in a very short time the mine will reach its terminal velocity where acceleration of the propulsive force of the bouyancy is exactly counteracted by the drag.

Figure 9:
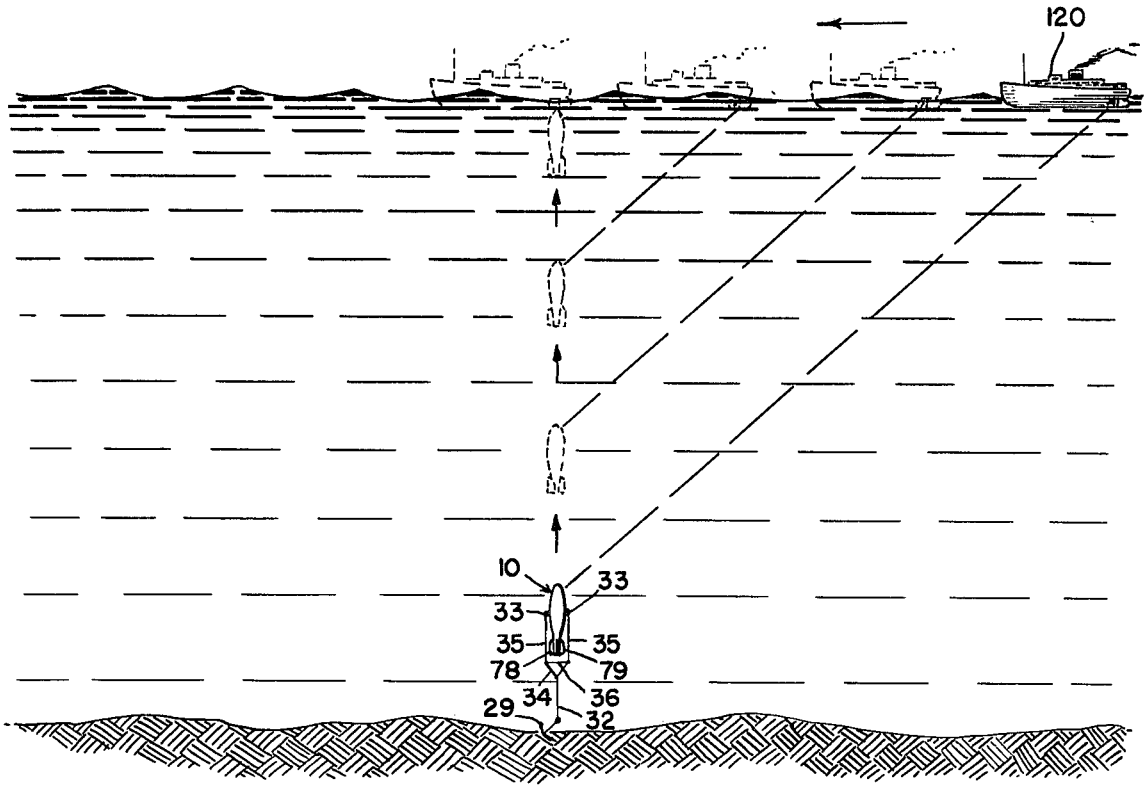
FIG. 9 is a diagram showing the course of the mine under conditions where the target ship is struck directly overhead.

In an exceptional case, where the target is proceding at a uniform rate of speed and will pass directly above the mine at the time it reaches the surface, no control action will be required. As shown in FIG. 9, under these conditions the hydrophone assembly will remain pointed directly at the target throughout the homing phase without requiring any adjustment, and no control signals will be generated to operate the fins.

Under these conditions, as shown in FIG. 9, the ship 129 is shown moving from right to left and passing directly over the mine 10. The signal of the ship is picked up by the hydrophones, tilting the hydrophones in the direction of the ship. The mine is released, the ballast is ejected, and without adjustment of the fins, the mine rises in a vertical direction to hit the ship.

However, under most conditions, some control action will be required. Ordinarily the combined motions of the mine and the target will initially tend to move the hydrophone axis away from the direction of the target. As this happens the hydrophone signals presented to the phase detectors through the tracking amplifiers and electronic switches will begin to get out of phase. The outputs of the phase detectors will no longer be zero and these outputs will be amplified in the training amplifiers and drive the training actuators in a direction to bring the axis of the hydrophone assembly back toward the target. At this time, however, unlike the operation before release, the rate gyros, servo amplifiers and fin actuators have been energized and are in operation. As the training actuators start to move the hydrophone assembly, the rate gyros will generate signals indicative of this movement. These signals are applied through the servo amplifiers and control the fin actuators to operate the steering portions of the fins.

Figure 10:
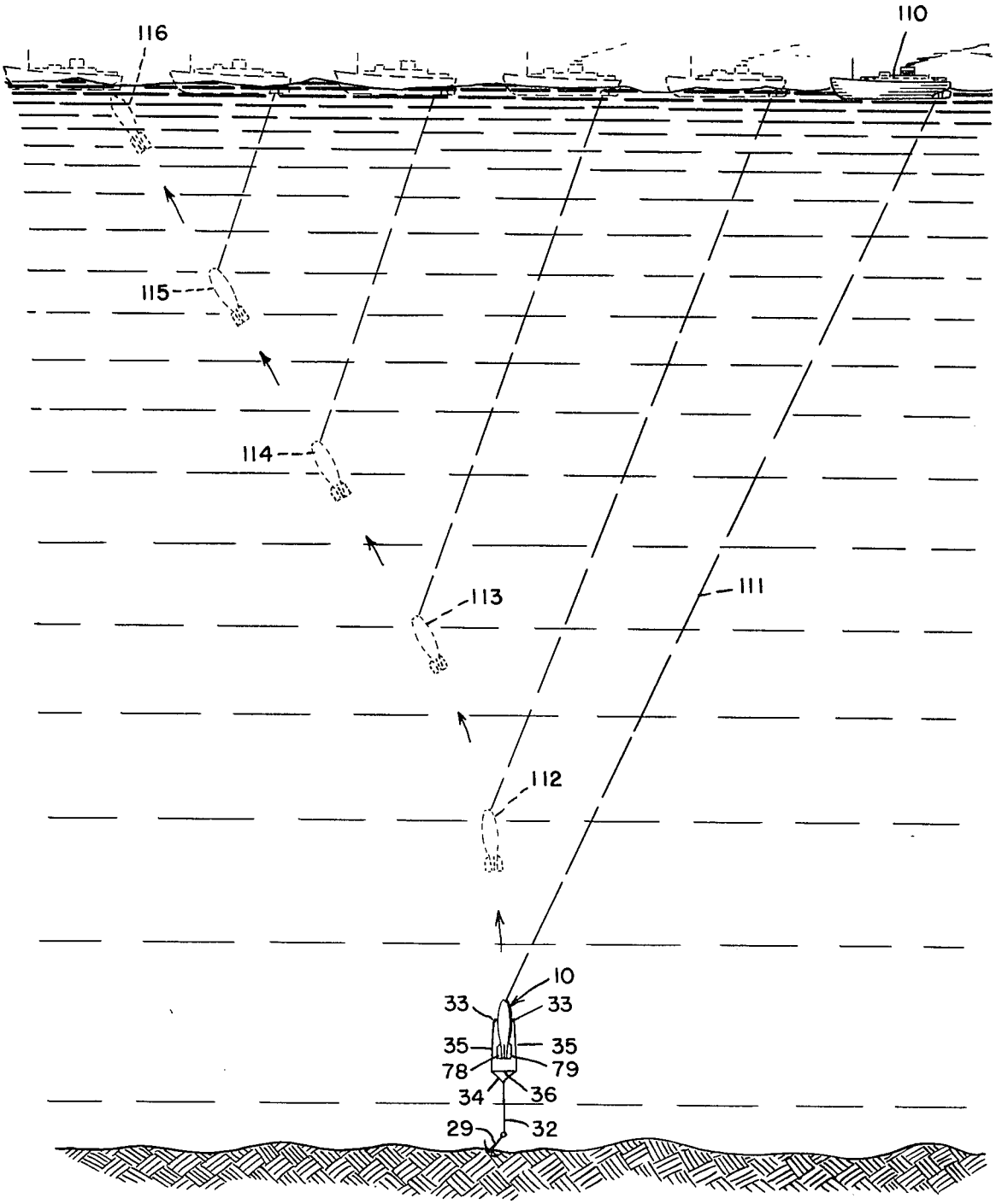
FIG. 10 is a diagram showing the course of the mine under the condition where the target ship is struck a period of time after having passed over the anchorage location.

Thus, there are two separate operations tending to bring the axis of the hydrophone assembly back on the target, the training mechanism within the mine and the steering mechanism which guides the mine as a whole. Each time it is necessary to operate the training mechanism, the steering mechanism will also be operated. As a result of this operation the mine will eventually attain a course where no additional training is required. At this point the course will be a collision course and unless evasive action is taken the mine will hit the target. The ratio between these two control operations can be proportioned dependent upon the depth of the mine, the speed of the mine and the expected speed of the target so as to give the optimum trajectory. In general, for greater depths the proportion of control allocated to the steering mechanism will be less, since greater time will be available for attaining a collision course and a more efficient trajectory will be realized. The foregoing conditions are exemplified in FIGS. 10 and 11. FIG. 10, a sectional diagram, shows in two dimensions the mine 10 anchored in a body of water. A ship 110 enters the cone of influence of the mine, for example, at the right side of FIG. 10. As heretofore explained, the hydrophone assembly 15 is tilted in the direction of the ship 110, in this case, along the line 111, the mine is released when the signal is of sufficient strength and begins to rise vertically. As the ship moves toward the left in the example of FIG. 10 the hydrophone assembly must tilt slightly to the left to remain in alignment with the target ship, this movement causing a corresponding operation of the fins to steer the mine toward the left as in the position 112. When all the hydrophones are aligned or receiving the signal in phase, as in position 113, the fins return to a neutral position. The mine now is on a collision course and continues this course as at 114, 115, 116 without change in the positions of the fins, hitting the ship at 116. It is, of course, understood that the foregoing is a simplification of the conditions actually encountered during the travel of the mine toward the ship. Many slight changes in course may be necessary to neutralize the effects of currents in the water caused by tides or other such phenomena or to offset the evasive tactics of the target ship.

Figure 11:
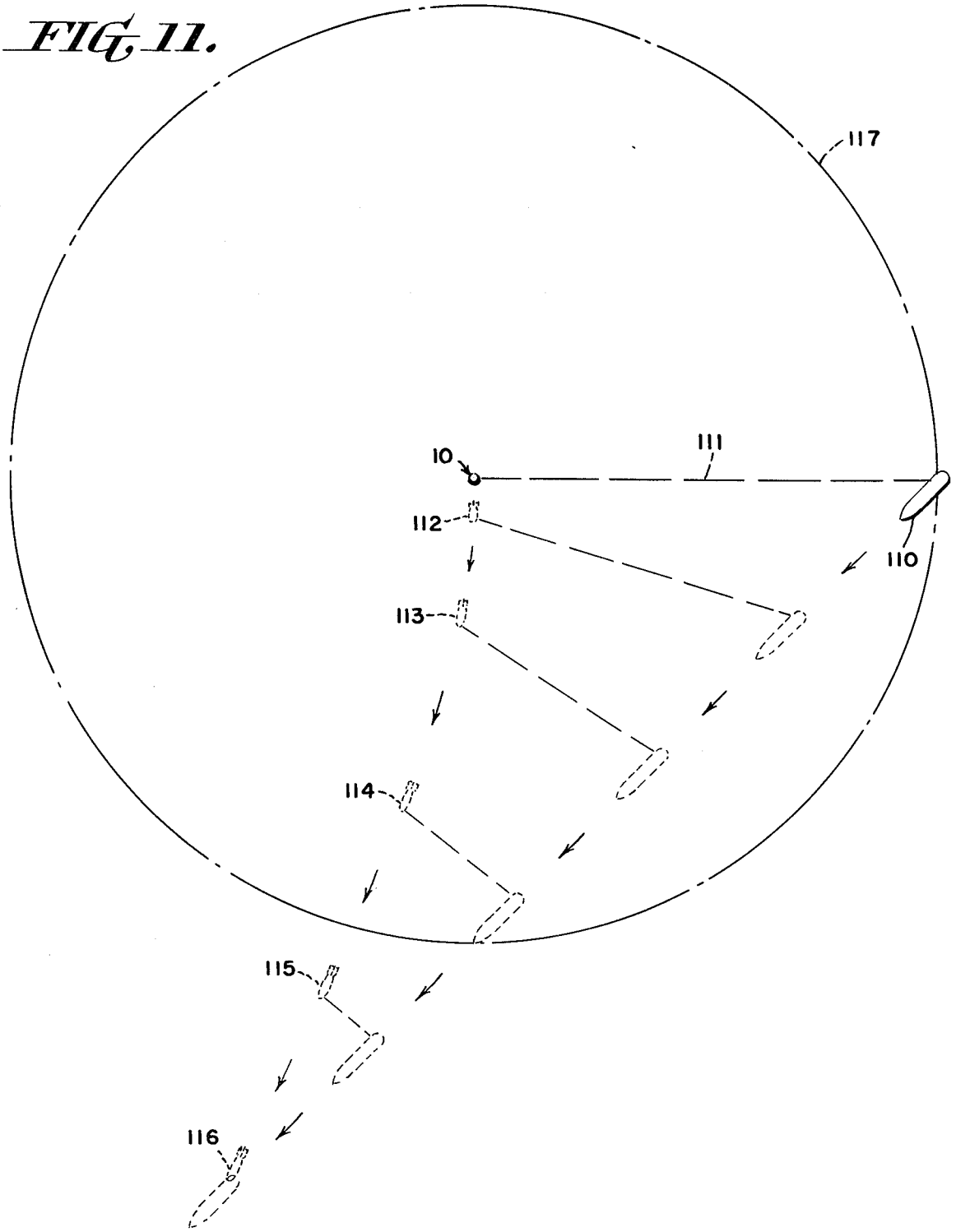
FIG. 11 is a diagrammatic plan view showing a third dimension in the travel of the mine toward a target ship.

FIG. 11 is a diagram in top plan and shows a third dimension in the travel of the mine. The outer limit of the conical area of sensitivity is indicated at 117, the mine 10 being located at the center thereof. The ship 110 is shown entering the area of sensitivity 117. The positions showing the relationship of the mine with respect to the ship are substantially the same as those of FIG. 10 and the same reference numerals are employed. It is clear that the mine rises vertically on its course as in FIG. 10 and simultaneously therewith may follow a horizontal course as shown at 112, 113, 114, 115, 116 in FIG. 11. As the hydrophone assembly is mounted for universal tilting movement the disc is capable of following the three-dimensional conditions combined in FIGS. 10 and 11, regardless of the orientation of the mine with respect to the ship.

Obviously many modifications and variations of the present invention are possible in the light of the above teachings. It is therefore to be understood that within the scope of the appended claims the invention may be practiced otherwise than as specifically described.

What is claimed is:

1. A buoyant target-seeking mine comprising, a hollow casing having nose, body, and tail sections, a hydrophone assembly mounted in said nose section, steering elements mounted on said tail section, amplifying circuit means connected to said hydrophone assembly, means influenced by said circuit means to move said steering elements in a direction to steer said mine toward a target producing sound above a predetermined amplitude, an orifice in said tail section for the passage of water ballast into and out of said casing, a first independent buoyancy control means for maintaining a predetermined amount of said ballast water in said casing during descent of said mine to anchorage, said ballast water being retained in said casing during said anchorage, a second buoyancy control means under the control of said circuit means for exhausting said ballast water, means for releasing the mine from said anchorage when said sound producing target influences said circuit means whereby said mine is free to rise rapidly to the surface of the water by reason of the increased buoyancy of said casing, and means under the control of said circuit for steering said mine toward said noise-producing target during its rise to the surface.

2. A deepwater mine comprising weighted anchoring means to cause said mine to descend to the bottom of a body of water, a ballast chamber having an opening therein to permit the entry of water as said mine descends, gas generating means actuated by the water within said ballast chamber upon reaching a predetermined level during descent to release sufficient gas within said chamber to displace only enough water to maintain said predetermined level to limit the rate of descent and to maintain slight positive buoyancy in said mine against said anchoring means, second means for generating a quantity of gas under pressure sufficient to displace the water in said ballast chamber, acoustic target detection means, and control means responsive to detection of an acoustic target signal by said target detection means and operative to release said anchoring means and energize said second gas generating means whereby the water is displaced from said ballast chamber to create positive buoyancy so that said mine will proceed toward the surface under the influence of said buoyancy.

3. A mine as set forth in claim 2 further including guidance means, operably controlled under the influence of said target detection means for attaining and maintaining said mine on a course as it proceeds toward the surface such that it will intercept the course of said acoustic target signal.

4. A buoyancy propelled target-seeking mine comprising releasable anchoring means for mooring said mine in a body of water, ballast ejecting means for positively displacing a sufficient quantity of ballast from said mine to cause it to become highly buoyant, acoustic sensing means responsive to the direction and intensity of sonic signals received thereby, guidance means influenced by said sensing means for steering said mine on a collision course with the source of said sonic signals, and electronic circuit control means responsive to receipt of sonic signals by said sensing means for causing sequential release of said anchoring means, actuation of said ballast ejecting means, and operation of said guidance means whereby said mine will be permitted to rise toward the surface under the influence of buoyancy and will be guided to intercept the source of said sonic signals.

5. In an acoustic homing mine, a steering system comprising a transducer assembly tiltably mounted within the nose of said mine for receiving acoustic signals from the body of water surrounding said mine, said transducer assembly comprising a plurality of sensitive elements arranged in four groups, the centers of said groups being positioned at the four corners of a square, said transducer assembly having its axis initially oriented along the axis of said mine so as to be influenced by sounds occurring in a volume of water of conical shape having its apex at the nose of said mine, training means responsive to acoustic signals received by said transducer assembly for tilting the axis of said transducer assembly toward the source of said signals, said training means including switching means for alternately connecting the groups on said transducer assembly into two pairs comprising groups at opposite sides of the square formed by said groups on said transducer assembly, rate sensitive means attached to said transducer mounting operative to provide output signals indicative of the rate and direction of tilting of said transducer assembly, and steering means actuated by said output signals for causing said mine to change its course in the same direction as said transducer assembly is tilted.

* * * * *